US007177590B1

(12) United States Patent
Stevens

(10) Patent No.: US 7,177,590 B1
(45) Date of Patent: Feb. 13, 2007

(54) SYSTEM AND METHOD FOR IMPLEMENTING A RETRANSMISSION BRIDGE

(75) Inventor: James A. Stevens, Lucas, TX (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 488 days.

(21) Appl. No.: 10/315,402

(22) Filed: Dec. 10, 2002

(51) Int. Cl.
*H04H 1/00* (2006.01)

(52) U.S. Cl. ..... 455/3.04; 455/414.4; 455/418; 455/414.1; 709/230

(58) Field of Classification Search ..... 455/418, 455/419, 550.1, 552.1, 423, 7, 3.04, 3.05, 455/3.06, 412.1, 414.1, 414.4, 420, 426.1, 455/428; 453/420; 709/238, 230, 246; 370/400, 370/328; 395/680
See application file for complete search history.

(56) References Cited

U.S. PATENT DOCUMENTS

| | | | | |
|---|---|---|---|---|
| 4,573,207 | A * | 2/1986 | Smith et al. | 455/509 |
| 5,592,480 | A | 1/1997 | Carney et al. | 370/347 |
| 5,822,585 | A * | 10/1998 | Noble et al. | 719/316 |
| 5,898,679 | A * | 4/1999 | Brederveld et al. | 370/315 |
| 5,940,384 | A | 8/1999 | Carney et al. | 370/347 |
| 6,011,785 | A | 1/2000 | Carney et al. | 370/330 |
| 6,842,617 | B2 * | 1/2005 | Williams et al. | 455/444 |
| 2002/0018487 | A1 * | 2/2002 | Chen et al. | 370/465 |
| 2002/0025832 | A1 * | 2/2002 | Durian et al. | 455/556 |
| 2002/0151325 | A1 * | 10/2002 | Fitton et al. | 455/553 |
| 2003/0050055 | A1 * | 3/2003 | Ting et al. | 455/419 |
| 2003/0158954 | A1 * | 8/2003 | Williams | 709/230 |
| 2004/0131025 | A1 * | 7/2004 | Dohler et al. | 370/328 |

OTHER PUBLICATIONS

What We Do: Networking: Advanced Network Communications System, p. 1 of 1, BBN Technologies, http://www.bbn.com/networking/ancs.html.

* cited by examiner

*Primary Examiner*—Matthew D. Anderson
*Assistant Examiner*—Tan Trinh
(74) *Attorney, Agent, or Firm*—Nathan O. Jensen; Kyle Eppele

(57) ABSTRACT

A method of and apparatus for implementing a radio retransmission bridge is disclosed. The method and apparatus includes devices and operations for creating a retransmission bridge software object with a base class application programming interface (API). The method and apparatus also includes devices and operations for creating waveforms with APIs inherited from the base class retransmission bridge API. The method and apparatus also includes devices and operations for identifying crossbanding waveforms being requested. Further, the method and apparatus include devices and operations for determining a location in a data stack in which to instantiate the retransmission bridge API, and instantiating the retransmission bridge API.

27 Claims, 11 Drawing Sheets

Retransmission Service Functions

Functional Organization of Different Types of Voice Service Waveforms

Example Interconnection of Plain Text Voice Via Standard Audio Representation

Cipher Text Voice (e.g., ESIP SC/CT Voice)

Cipher Text Voice (e.g., Link 16 Mode 1 (CT) LPC-10e Voice))

Cipher Text VoIP (e.g., WNW CT VoIP -with MELP)

JTR Set Red Audio I/O

Example Interconnection of Cipher Text Voice Via Standard Audio Representation

Example Interconnection of Similar Plain Text Voice Via Standard Vocoder Representation Example Interconnection of Similar Cipher Text Voice Via Standard Vocoder Representation Example Interconnection of Similar Cipher Text Voice Using the Same Encryption Algorithm and Keys

Statically Preconfigured

User on Net A is Automatically Retransmitted to Net B by Static Retransmission Service

Manually Configured Locally

User on Net A Talk to Operator Who Manually Patches in Retransmission to Net B

Remotely Dialed

User on Net A "Dials" up retransmission Service to Net B

Potential Retransmit Bridge Locations. The retransmit bridge can be instantiated at multiple locations in voice and serial data stacks to support retransmissions across a wide range of modes.

SYSTEM AND METHOD FOR IMPLEMENTING A RETRANSMISSION BRIDGE

REFERENCE TO RELATED PATENT APPLICATIONS

This Application is related to U.S. patent application Ser. No. 10/315,436 titled "Over-The-Air Signaling Service Method and Apparatus", filed on the same day herewith and which is incorporated herein by reference.

BACKGROUND OF THE INVENTION

The invention relates generally to wireless radio systems. The invention also relates to push-to-talk radio systems which may be retrofitted with equipment to interface with multiple frequency band, multiple channel radio systems using a retransmission bridge. Further, the invention relates to a software defined radio crossbanding and retransmission service.

Stovepipe Legacy radios and Legacy wireless networks are conventionally difficult to upgrade to support new services or interoperate with other network systems. Conventionally, human operators at a new service site may be used to intervene to proxy for Legacy users to support new services. Switching/interconnection equipment may be used to support crossbanding or retransmission services between these different systems, but are either limited to predefined communication planning or require manual human operator intervention at the switching/interconnection equipment site(s).

Prior to the advent of multichannel software defined radios, voice and serial data retransmission services required the interconnection of two radios via physical cabling and the manual coordination of the radio modes and settings.

Accordingly, there is a need to easily and inexpensively allow stovepiped Legacy radio systems or other systems to support new services or interoperate with other systems without using predefined crossbanding/retransmission communication planning or requiring manual operator intervention at the switching/interconnection sites. There is also a need for a crossbanding and retransmission service for a software defined radio that uses application programming interface (API) software objects that support a plurality of crossbanding and retransmission services through inheritance from a common base class.

It would be desirable to provide a system and/or method that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY

An example of the invention relates to a method of implementing a radio retransmission bridge. The method includes creating a retransmission bridge software object which provides a base class application programming interface (API). The method also includes creating waveform protocol stack objects which use APIs inherited from the retransmission bridge API base class. The method further includes identifying crossbanding waveforms being requested. Further still, the method includes determining a location in the waveform protocol data stack objects with identical APIs inherited from the retransmission bridge base class API, and instantiating the retransmission bridge at identical waveform protocol stack APIs inherited from the retransmission bridge base class API.

Another example of the invention relates to an apparatus configured to implement a radio retransmission bridge. The apparatus includes a means for creating a retransmission bridge software object with a base class application programming interface (API). The apparatus also includes a means for creating waveforms with APIs inherited from the retransmission bridge base class API. The apparatus also includes a means for identifying crossbanding waveforms being requested. The apparatus further includes a means for determining a location in a data stack in which to instantiate the retransmission bridge, and a means for instantiating the retransmission bridge.

Yet another example of the invention relates to a software defined radio (SDR), used as a retransmission service. The SDR includes a processor, a memory coupled to the processor, a transceiver, and a program stored in memory and running on the processor. The program instantiates an application programming interface (API) that inherits from a base class. The API defines the retransmission bridge.

Alternative examples and other exemplary embodiments relate to other features and combination of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF PREFERRED AND EXEMPLARY EMBODIMENTS

Figure 1:
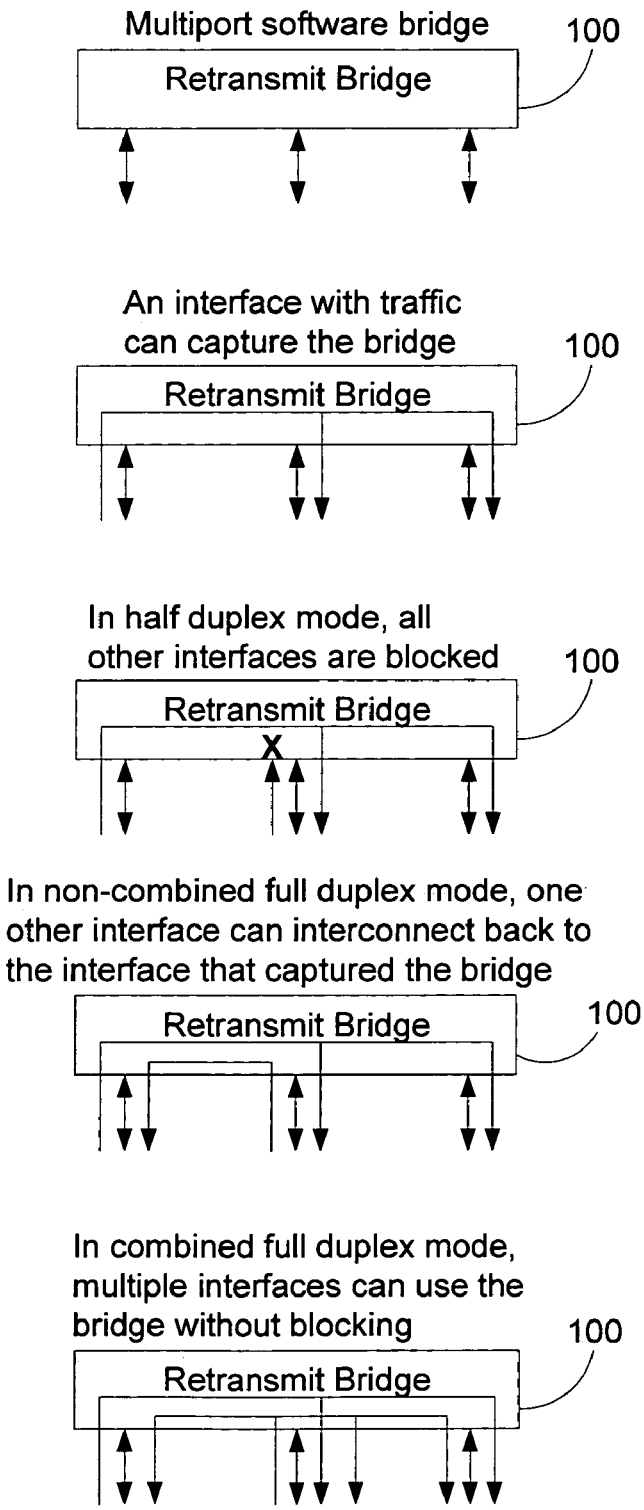
FIG. 1 is an exemplary depiction of a multiport software retransmission bridge.

Before describing, in detail the particular improved system and method, it should be observed that the invention includes, but is not limited to a novel structural combination of conventional data/signal processing components and communications circuits, and not in the particular detailed configurations thereof. Accordingly, the structure, methods, functions, control and arrangement of conventional components and circuits have, for the most part, been illustrated in the drawings by readily understandable block representations, schematic diagrams, and tables in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

In an exemplary embodiment, a common retransmission bridge that interconnects voice and data waveform/protocol stacks may be implemented. In an exemplary embodiment, the retransmission bridge can be used to interconnect similar and dissimilar voice service waveforms at the same security level and similar and dissimilar serial data service waveforms at the same security level.

As depicted in FIG. 1, a retransmission bridge 100 may be a multiport software bridge. The ports can be half or full duplex. In an exemplary embodiment, only one port at a time can capture bridge 100, rules can be selected to determine which source captures the bridge (first come first served, last come first served, or port precedence level). The ports can either be waveforms or alternatives, such as but not limited to the retransmission set of baseband interfaces for a software defined radio (SDR).

According to a particular example, if the retransmission bridge is interconnecting Cipher Text (CT) traffic, the bridge may be instantiated in a Red Processor of one of the interconnected waveforms of a SDR. If the retransmission bridge is interconnecting Plain Text (PT) traffic or encrypted bits, it may be instantiated in a Black Processor of one of the interconnected waveforms of the SDR.

Figure 2:
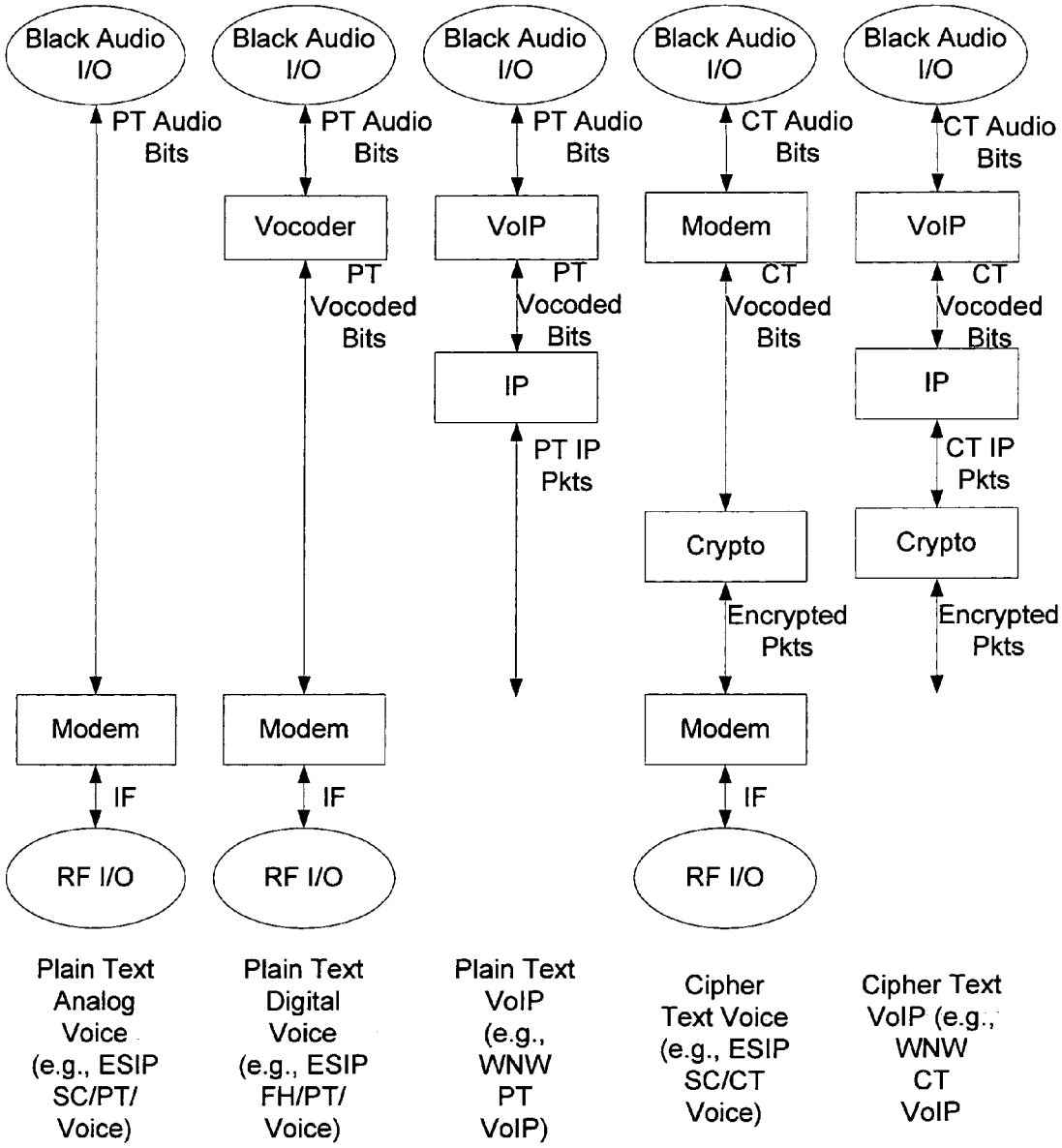
FIG. 2 is an exemplary depiction of a functional organization of different types of voice service waveforms.

Referring now to exemplary FIG. 2, FIG. 2 depicts various locations where a digital retransmission bridge could be inserted for voice: (i) Plain Text (PT) audio bits, (ii) PT Vocoded bits, (iii) Cipher Text (CT) audio bits, (iv) CT Vocoded bits, and (v) PT Encrypted bits.

In conventional systems, different radios and even different waveform implementations within the same radio could have different internal representations for audio data. Accordingly, it would be advantageous to implement a single standard internal audio representation that would simplify the interconnection of different waveforms and SDR audio interfaces.

Figure 3:
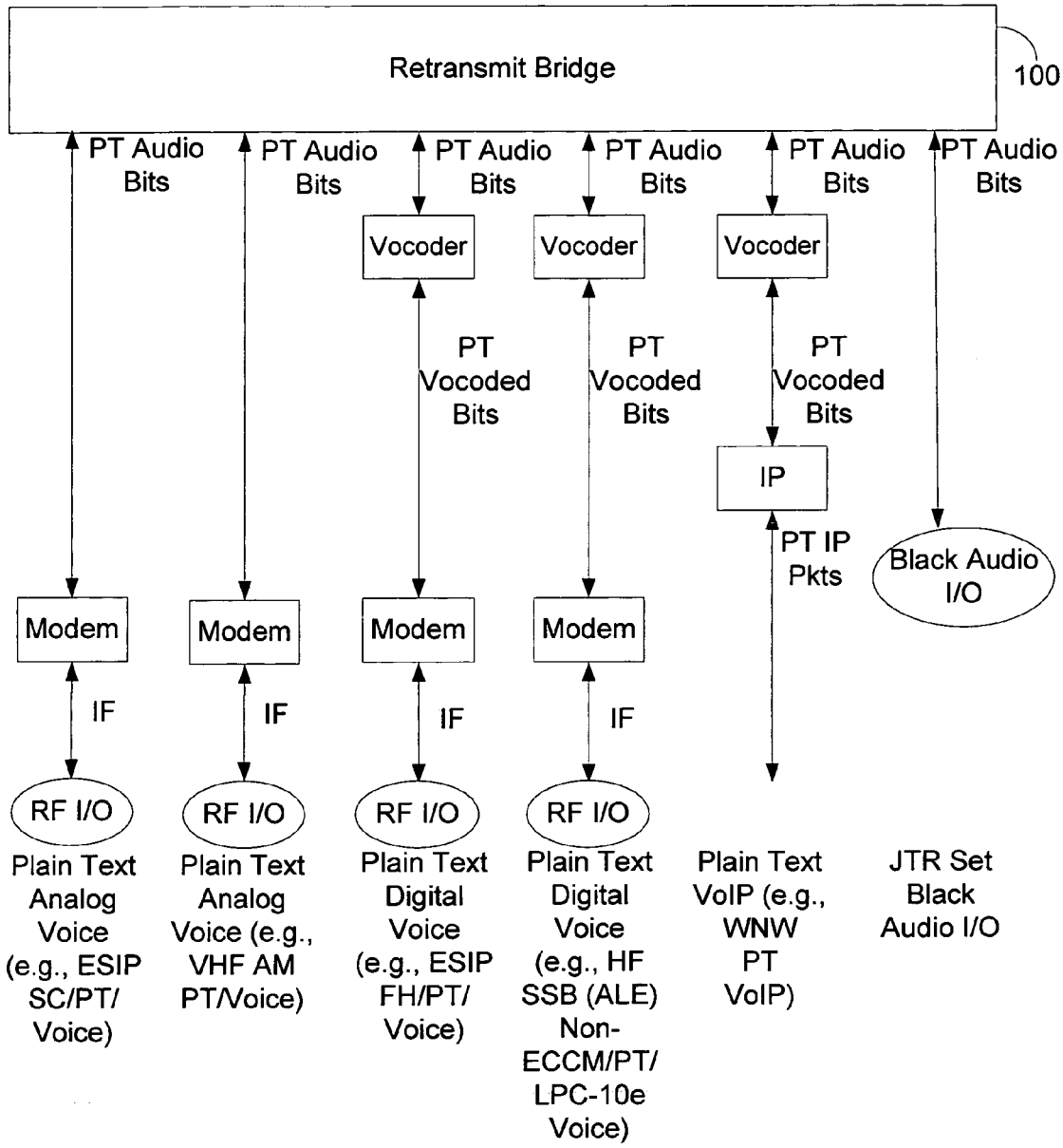
FIG. 3 is an exemplary depiction of an interconnection of plain text voice via standard audio representation.

Referring now to FIG. 3, FIG. 3 illustrates how retransmit bridge 100 may be used to interconnect Plain Text voice at the point where it is in a single standard internal audio representation. Retransmit bridge 100 may interconnect similar and dissimilar PT Voice waveforms and even black SDR audio interfaces.

Figure 4:
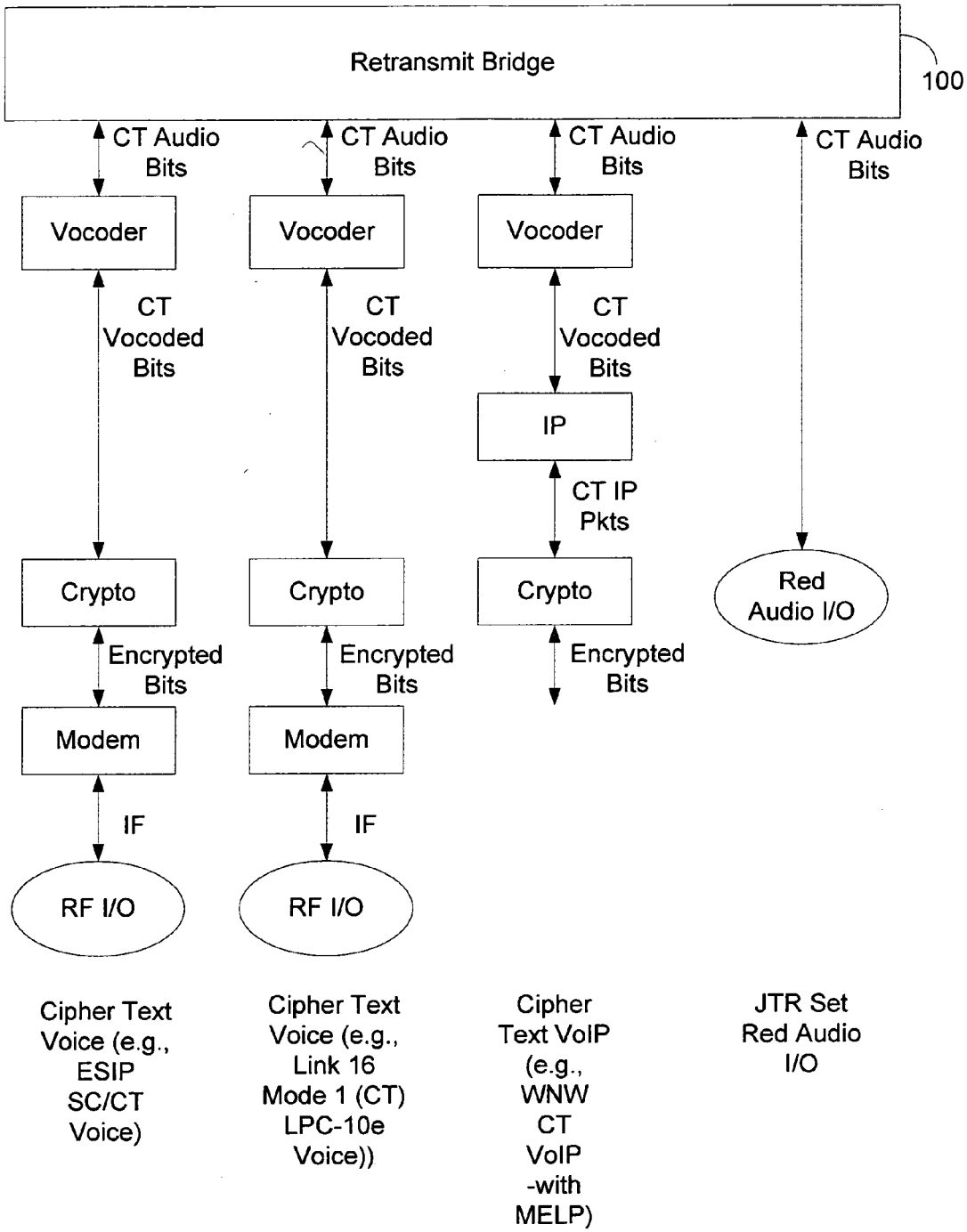
FIG. 4 is an exemplary depiction of an interconnection of Cipher text voice via standard audio representation.

Referring now to FIG. 4, FIG. 4 illustrates how the retransmit bridge may also be used to interconnect Cipher Text voice at the point where it is in a single standard internal audio representation. Retransmit bridge 100 may interconnect similar and dissimilar CT Voice waveforms and even red SDR audio interfaces.

In an exemplary embodiment, each vocoder algorithm may have a single standard internal block representation that may be used to pass vocoded bits. This may insure that similar digital voice waveforms, i.e. waveforms using the same vocoder algorithm, can be retransmitted digitally without having to undergo a voice quality degrading digital-to-analog-to-digital conversion. (Different non-interoperable variants of similar vocoder algorithms will be treated as if they were different vocoder algorithms.)

Figure 5:
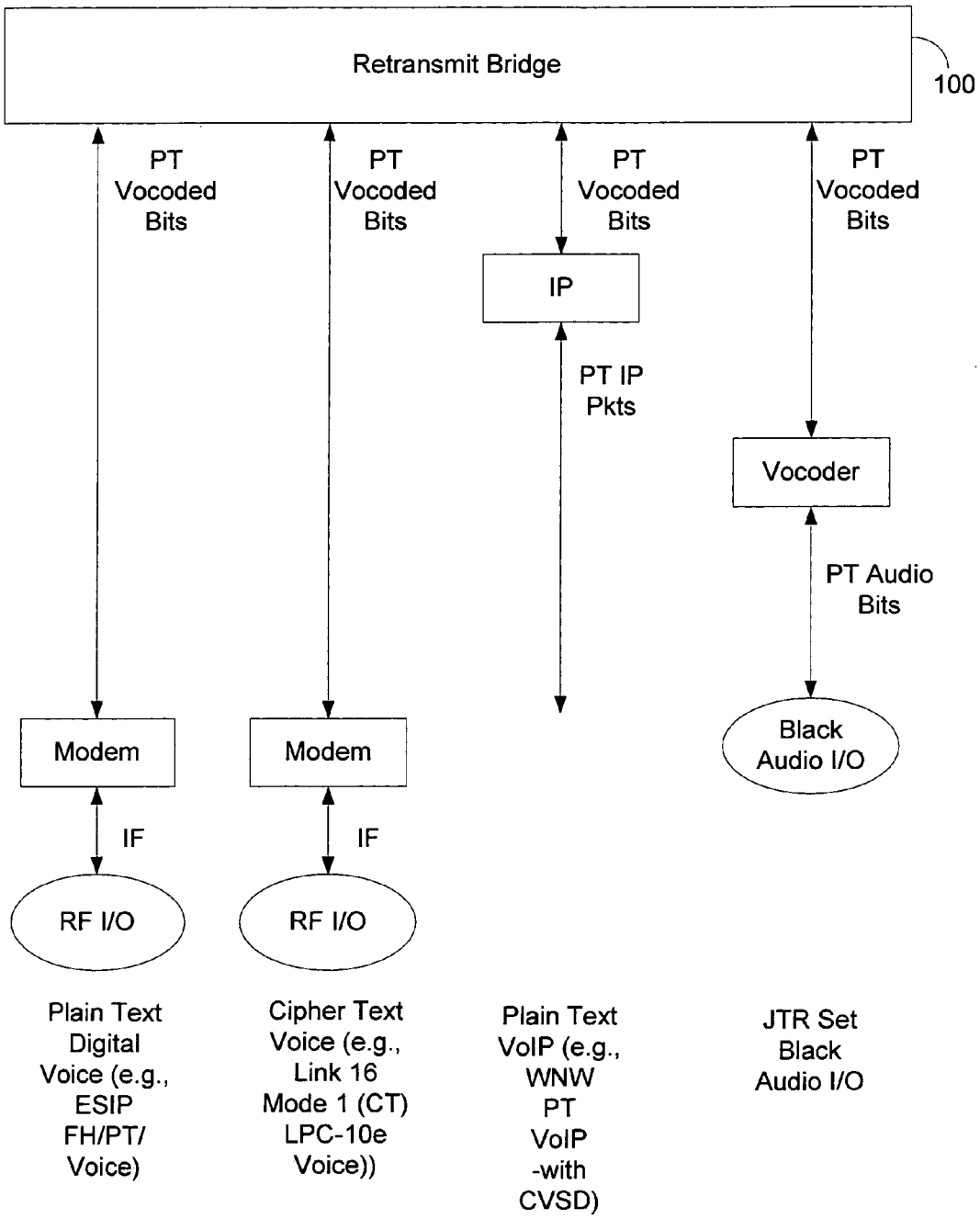
FIG. 5 is an exemplary depiction of an interconnection of similar plain text voice via standard vocoder representation.

Referring to FIG. 5, FIG. 5 illustrates how retransmit bridge 100 may be used to interconnect Plain Text voice at the point where it is in a single internal vocoder representation. Retransmit bridge 100 may interconnect similar PT Voice waveforms and even black SDR audio interfaces.

Figure 6:
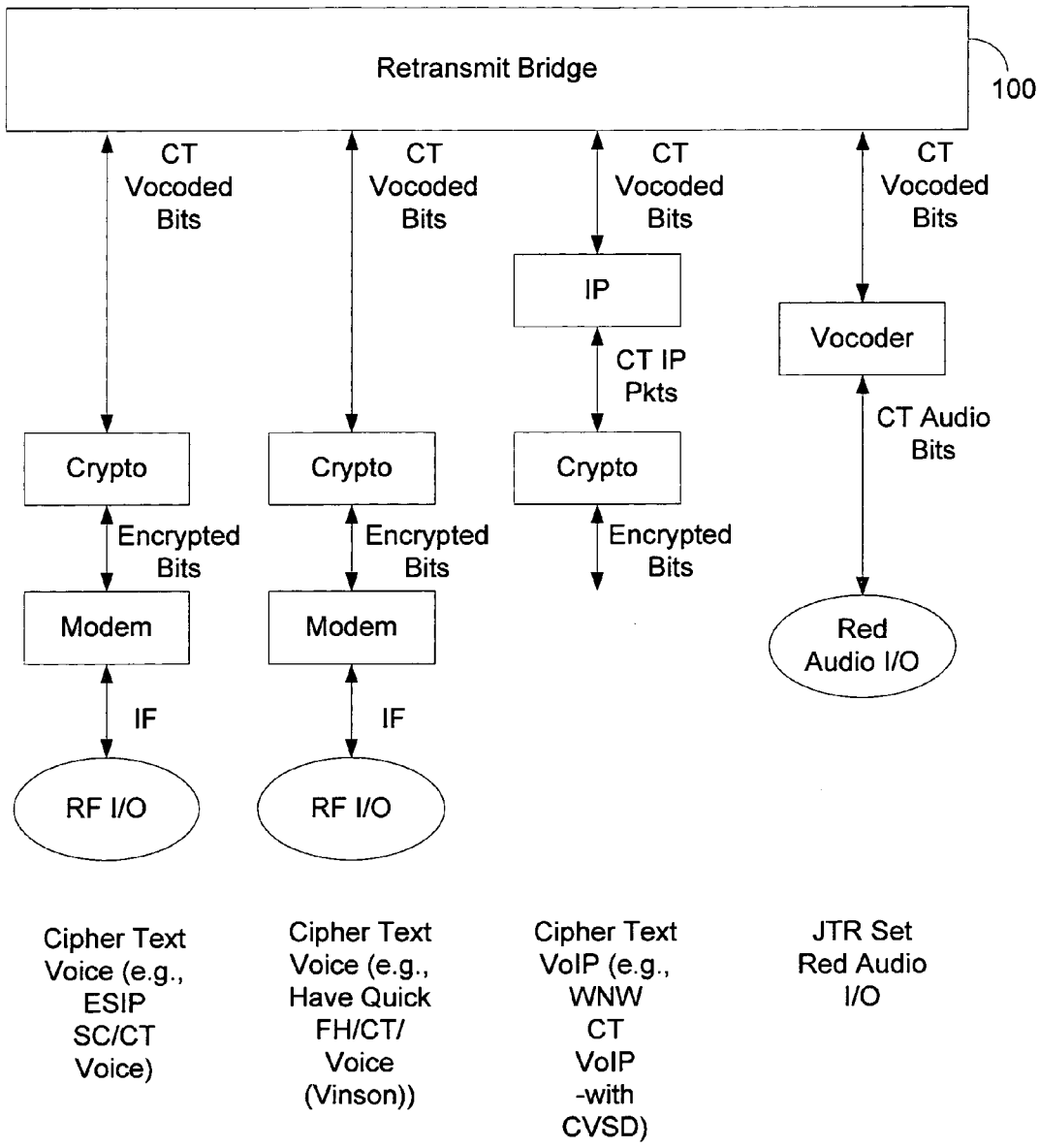
FIG. 6 is an exemplary depiction of an interconnection of similar Cipher Text voice via standard vocoder representation.

Referring now to FIG. 6, FIG. 6 illustrates how retransmit bridge 100 may be used to interconnect Cipher Text voice at the point where it is in a single internal vocoder representation. Retransmit bridge 100 may be used to interconnect similar CT Voice waveforms and even red SDR audio interfaces.

According to an exemplary embodiment, each encryption algorithm may have a single standard internal block representation that may be used to pass encrypted bits on the black side. This may insure that similar digital voice waveforms, i.e., waveforms using the same vocoder algorithm, using the same encryption algorithm and the same keys, may be retransmitted on the black side without having to undergo a latency increasing decryption, then encryption process.

Figure 7:
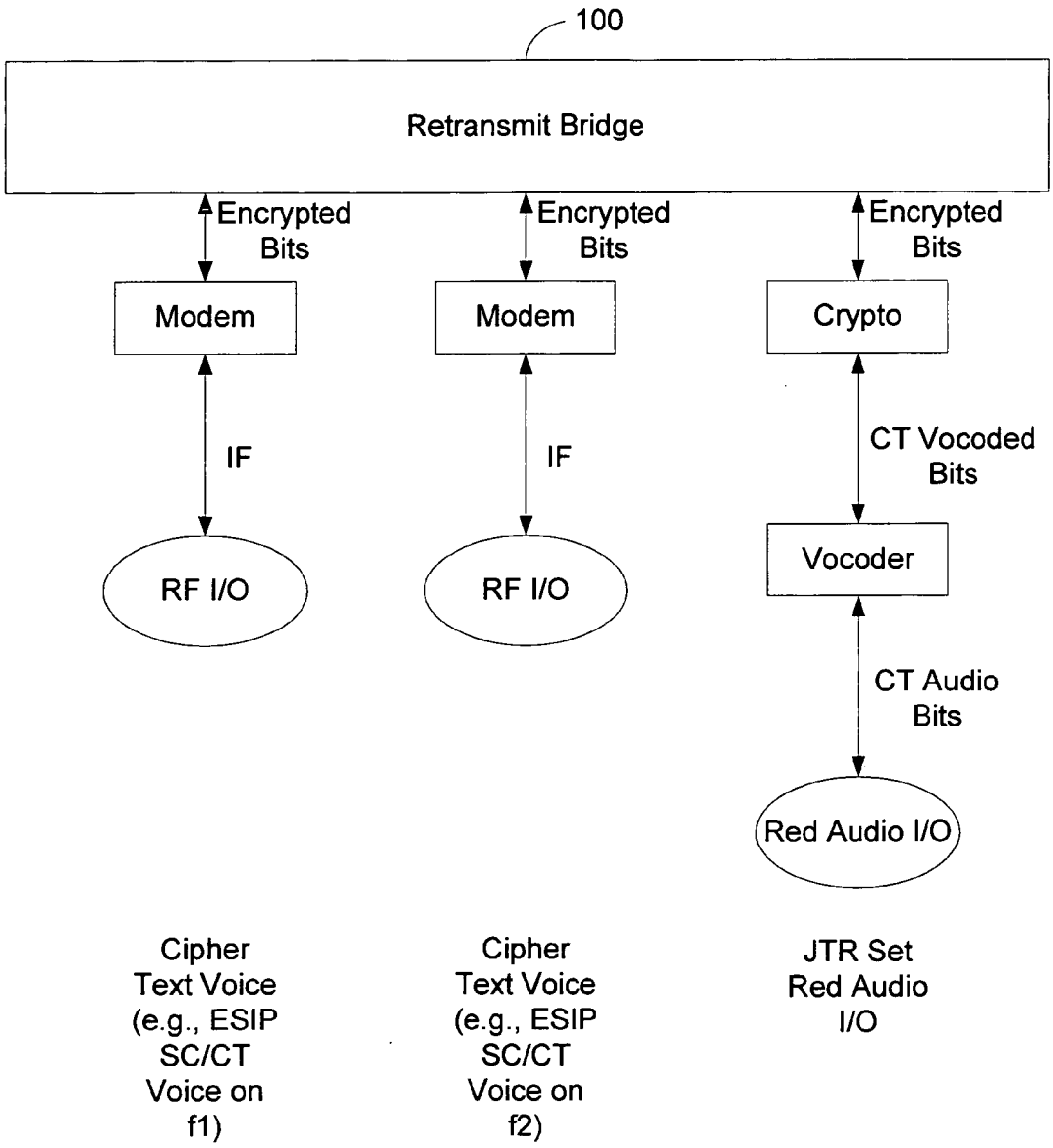
FIG. 7 is an exemplary depiction of an interconnection of similar Cipher Text voice using the same encryption algorithm and keys.

Referring now to FIG. 7, FIG. 7 illustrates how the retransmit bridge may be used to interconnect Cipher Text voice at the point where it is in a single internal encrypted representation on the black side of an SDR. Retransmit bridge 100 may interconnect similar CT Voice waveforms and even pass the data on up through the SDR crypto to a red SDR audio interfaces.

Similar Serial Data waveforms may be interconnected and retransmitted in the same way that Similar Voice waveforms are.

Figure 8:
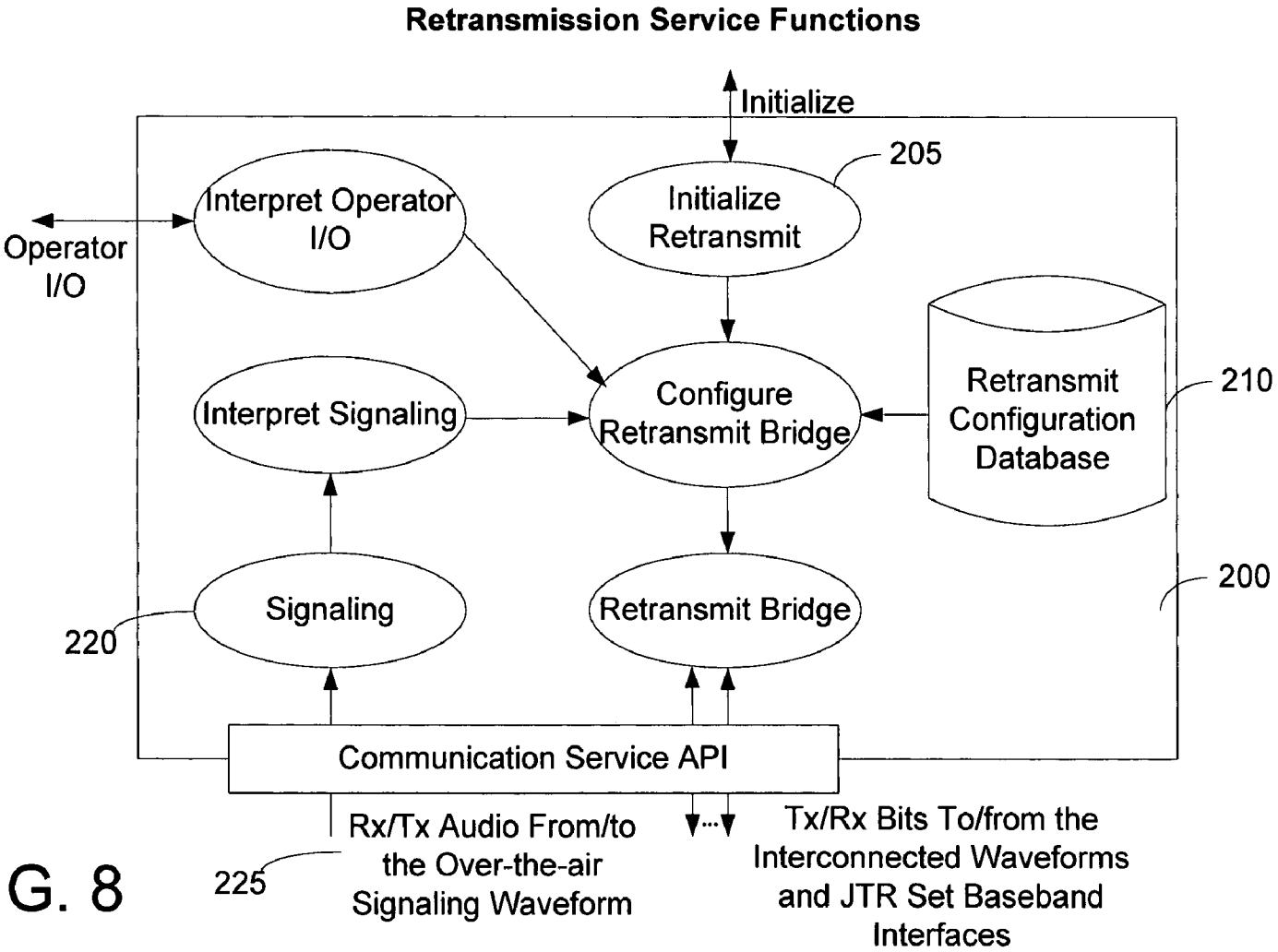
FIG. 8 is an exemplary depiction of retransmission service functions.

Referring now to FIG. 8, FIG. 8 illustrates an exemplary retransmission service functional design 200. As discussed above, three types of retransmission services may be provided: static retransmission, manually controlled retransmission, and dynamic over-the-air signaling. Static retransmission may be set up when the retransmission service is initialized 205. The retransmission parameters may be read from the Retransmit Configuration Data Base 210. The manually controlled retransmission may be set up by the SDR operator at the retransmission SDR. Dynamic over-the-air signaling retransmission may be set up by the received signaling 220 received on the over-the-air signaling waveform 225.

An exemplary SDR Retransmission Service may enable automatic retransmission and routing operations between channels that are processing mode-compatible traffic at the same security level and use a standard audio representation that supports retransmission of similar and dissimilar voice modes. The exemplary Retranmission Service may interconnect serial data modes that have been coordinated end to end.

Additionally, a SDR may be configured to support over-the-air signaling so that Legacy radio users can "dial" into a SDR to connect with other waveforms and networks. Previously, Legacy users were limited to preassigned retransmission frequencies, or they needed an operator to manually patch in the desired retransmission crossbanding.

Figure 9:
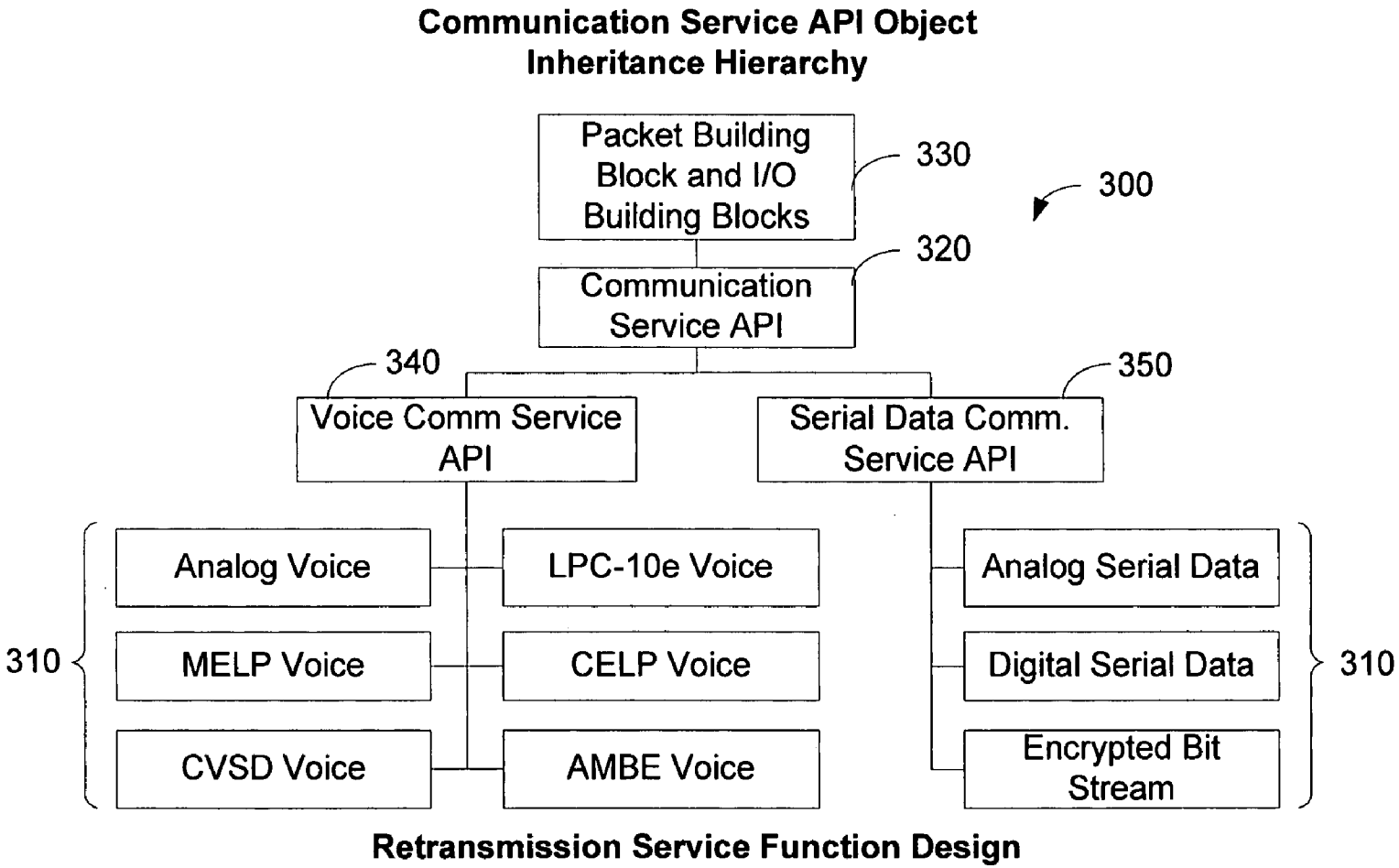
FIG. 9 is an exemplary depiction of a communication service API object inheritance hierarchy.

Referring now to FIG. 9, FIG. 9 depicts an exemplary communication service API object inheritance hierarchy 300. Accordingly, it can be seen that particular retransmission service API objects 310 inherit from a base class of communication service API and further from packet building blocks and input/output building blocks 330. Each service further inherits from an intermediate class of either voice communication service API 340 or Serial Data Communication Service API 350.

Figure 10:
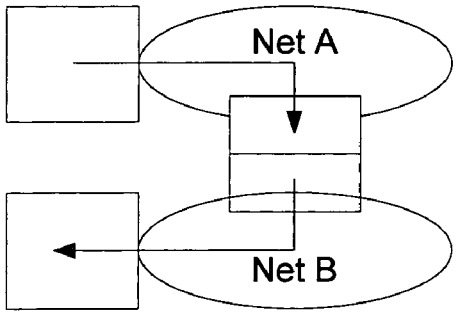
FIG. 10 is an exemplary depiction of a statically preconfigured user retransmission system.
Figure 11:
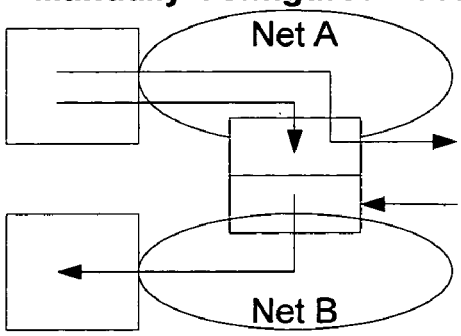
FIG. 11 is an exemplary depiction of a manually configured locally user retransmission system.
Figure 12:
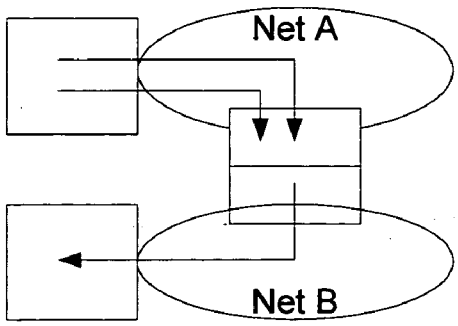
FIG. 12 is an exemplary depiction of a remotely dialed user.

Referring now to FIGS. 10, 11, and 12, the range of retransmission and relay features provided by an exemplary Retransmission service are depicted. Table 1 shows an example of which communication services may be supported by each SDR waveform and SDR wireline interface. These communication services fall into three categories: voice, serial data, and networking services. Table 2 summarizes an example of how to decide whether two waveforms may be interconnected via retransmission service, depending on whether two waveforms may be interconnected via retransmission service, and depending upon whether the waveforms have compatible mode communication services as provided in Table 3. Table 4 describes an exemplary method by which compatible communication services are retransmitted. Table 5 shows an example intermediate mapping of HF and ESIP waveform voice modes to the voice communication service.

TABLE 1

Interconnecting Two Waveforms
COMMUNICATION SERVICES BY WAVEFORMS AND WIRELINE INTERFACES

| | Communication Services | | | | | | | | | |
|---|---|---|---|---|---|---|---|---|---|---|
| | Voice | | | | | | | | Serial Data | |
| Waveforms and Wireline Interfaces | Analog Voice | LPC-10e Voice | MELP Voice | CELP Voice | CVSD Voice | AMBE Voice | VoIP | Analog Serial Data | Digital Serial Data | IP Networking |
| Waveforms | | | | | | | | | | |
| UHF DAMA 181 | | Y | | | Y | | | | Y | |
| UHF DAMA 182 | | Y | | | | | | | Y | |
| UHF DAMA 183 | | Y | | | Y | | | | Y | |
| UHF DAMA 184 | | | | | | | | | Y | |
| HF SSB (ALE) | Y | Y | Y | | | | | | Y | Y |
| HF ISB (ALE) | Y | Y | Y | | | | | | Y | Y |
| Have Quick II | Y | | | | Y | | | Y | Y | Y |
| ATC VHF Data | | | | | | Y | | | | |
| VHF for ATC | Y | | | | | | | | | |
| Link 16 | | Y | | | Y | | | | | |
| EPLRS | | | | | | | | | | Y |
| WNW | | Y | Y | Y | Y | Y | Y | | | Y |
| ESIP | Y | | | | Y | | | Y | Y | Y |
| Wireline Interfaces | | | | | | | | | | |
| Audio | Y | $Y_a$ | $Y_a$ | $Y_a$ | $Y_a$ | $Y_a$ | $Y_a$ | Y | | |
| Serial | | | | | | | Y | | Y | Y |
| Ethernet | | | | | | | Y | | | Y |
| 1553 | | | | | | | | | | |

| Waveforms and Wireline Interfaces | Networking | | | | |
|---|---|---|---|---|---|
| | ADDSI X.25 | MIL-STD-188-220 | HF Networking | UHF SATCOM | ATN Networking |
| Waveforms | | | | | |
| UHF DAMA 181 | | | | Y | |
| UHF DAMA 182 | | | | Y | |
| UHF DAMA 183 | | | | Y | |
| UHF DAMA 184 | | | | Y | |
| HF SSB (ALE) | | | Y | | |
| HF ISB (ALE) | | | Y | | |
| Have Quick II | | Y | | | |
| ATC VHF Data | | | | | Y |
| VHF for ATC | | | | | |
| Link 16 | | | | | |
| EPLRS | Y | | | | |
| WNW | | | | | |
| ESIP | | Y | | | |
| Wireline Interfaces | | | | | |
| Audio | | | | | |
| Serial | Y | Y | Y | Y | Y |
| Ethernet | Y | Y | Y | Y | |
| 1553 | Y | | | | |

Y Yes
$Y_a$ Digital voice comes in audio and is converted inside SDR

TABLE 2

| Interconnecting Two Waveforms<br>METHOD TO DETERMINE WHETHER TWO WAVEFORMS MAY BE INTERCONNECTED |
|---|
| 1. Look up communication services provided by the 2 waveforms (reference Table 1). |
| 2. Then look to see if any of the provided communication services can be interconnected (reference Table 3) |

TABLE 2-continued

| Interconnecting Two Waveforms<br>METHOD TO DETERMINE WHETHER TWO WAVEFORMS MAY BE INTERCONNECTED |
|---|
| 3. If any of the communication services have an interconnection method (reference Table 3) and the services are at the same security level, then the two services can be inteconnected according to that interconnection method (reference Table 4). |

TABLE 3

Interconnecting Two Waveforms
RETRANSMISSION AND RELAY BY COMMUNICATION SERVICES

| | Communication Service | | | | | | | | | |
|---|---|---|---|---|---|---|---|---|---|---|
| | Voice | | | | | | | | Serial Data | |
| Communication Service | Analog Voice | LPC-10e Voice | MELP Voice | CELP Voice | CVSD Voice | AMBE Voice | VoIP | Analog Serial Data | Digital Serial Data | IP Networking |
| Voice | | | | | | | | | | |
| Analog Voice | V1 | V1 | V1 | V1 | V1 | V1 | V1 | | | |
| LPC-10e Voice | V1 | V2 | V1 | V1 | V1 | V1 | V3 | | | |
| MELP Voice | V1 | V1 | V2 | V1 | V1 | V1 | V3 | | | |
| CELP Voice | V1 | V1 | V1 | V2 | V1 | V1 | V3 | | | |
| CVSD Voice | V1 | V1 | V1 | V1 | V2 | V1 | V3 | | | |
| AMBE Voice | V1 | V1 | V1 | V1 | V1 | V2 | V3 | | | |
| VoIP | V1 | V3 | V3 | V3 | V3 | V3 | V3 | | | |
| Serial Data | | | | | | | | | | |
| Analog Serial Data | | | | | | | | S1 | | |
| Digital Serial Data | | | | | | | | | S2, S3 | S4 |
| Networking | | | | | | | | | | |
| IP networking | | | | | | | | | S4 | |
| ADDSI X.25 | | | | | | | | | S4 | |
| MIL-STD-188-220 | | | | | | | | | S4 | |
| HF Networking | | | | | | | | | S4 | |
| UHF SATCOM | | | | | | | | | S4 | |
| ATN networking | | | | | | | | | S4 | |

| Communication Service | Networking | | | | |
|---|---|---|---|---|---|
| | ADDSI X.25 | MIL-STD-188-220 | HF Networking | UHF SATCOM | ATN Networking |
| Voice | | | | | |
| Analog Voice | | | | | |
| LPC-10e Voice | | | | | |
| MELP Voice | | | | | |
| CELP Voice | | | | | |
| CVSD Voice | | | | | |
| AMBE Voice | | | | | |
| VoIP | | | | | |
| Serial Data | | | | | |
| Analog Serial Data | | | | | |
| Digital Serial Data | S4 | S4 | S4 | S4 | S4 |
| Networking | | | | | |
| IP networking | | | | | |
| ADDSI X.25 | | | | | |
| MIL-STD-188-220 | | | | | |
| HF Networking | | | | | |
| UHF SATCOM | | | | | |
| ATN networking | | | | | |

See Table 4 for Vx Voice Retransmission Methods
Sx Serial Data Transmission Methods

TABLE 4

RETRANSMISSION AND RELAY METHODS DESCRIPTION

| Method | | Description (Blue indicates growth) |
|---|---|---|
| Voice | V1 | Interconnect audio bits to crossband bridge (reference Figure 13) |
| | V2 | If using same crypto algorithm and keys, then interconnect encrypted bits to crossband bridge; otherwise, interconnect vocoded bits to crossband bridge (reference Figure 13) |
| | V3 | If VoIP is using same vocoder as waveform, interconnect vocoded bits to crossband bridge; Otherwise, interconnect audio bits to crossband bridge (reference Figure 13) |
| Serial Data | S1 | Interconnect sampled bits to crossband bridge (reference Figure 13) |
| | S2 | Interconnect digital bits to crossband bridge (reference Figure 13) |
| | S3 | Interconnect waveform serial protocol serial bits to crossband bridge (reference Figure 13) |
| | S4 | Interconnect waveform serial protocol and PAD serial bits to crossband bridge (reference Figure 13) |

TABLE 5

Baseline Waveform Mode Mapping into Communication Services

| Waveform | Waveform Mode (CT = Cipher Text, PT = Plain Text) | Communication Service Mapping |
|---|---|---|
| HF SSB (ALE) | Non-ECCM/PT/Voice | Analog Voice |
| | Non-ECCM/PT/LPC-10e Voice | LPC-10e Voice |
| | Non-ECCM/PT/MELP Voice | MELP Voice |
| | Non-ECCM/CT/LPC-10e Voice | LPC-10e Voice |
| | Non-ECCM/CT/MELP Voice | MELP Voice |
| | ECCM/PT/Voice | Analog Voice |
| | ECCM/PT/LPC-10e Voice | LPC-10e Voice |
| | ECCM/PT/MELP Voice | MELP Voice |
| | ECOM/CT/LPC-10e Voice | LPC-10e Voice |
| | ECCM/CT/MELP Voice | MELP Voice |
| HF ISB (ALE) | The Mapping of HF ALE ISB Modes to Communication Services listedin Table 1 is identical to that of HFALE SSB above. | |
| ESIP | Single Channel (SC)/PT/Voice | Analog Voice |
| | SC/CT/Voice | CVSD Voice |
| | Frequency Hopping (FH)/PT/Voice | CVSD Voice |
| | FH/CT/Voice | CVSD Voice |

Figure 13:
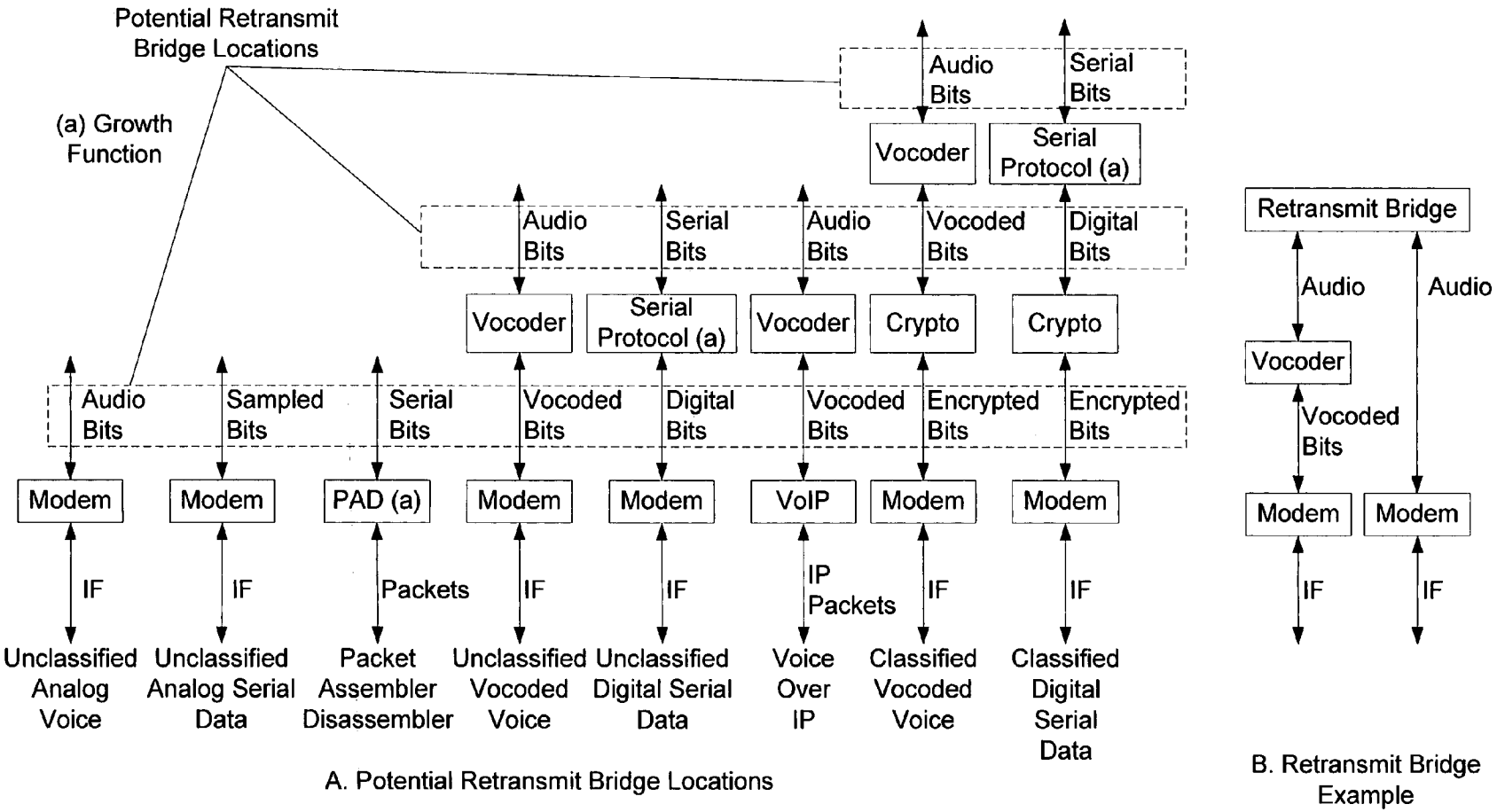
FIG. 13 is an exemplary depiction of potential retransmit bridge locations.

The Retransmission Service function may be instantiated at multiple locations in the voice and serial data protocol stacks to support retransmission across a wide range of voice and serial data modes, depicted in FIG. 13, for example. If waveforms use similar vocoders, then the vocoded bits may be directly retransmitted without performing a voice quality degrading vocoder-to-audio-to-vocoder conversion at the retransmission node. If the waveforms use different vocoders or analog voice, then standard common audio representations ensure that the different voice modes can be retransmitted. This common audio encoding also supports analog data retransmission. New waveforms with different vocoder modes can be ported into the SDR and seamlessly worked with the retransmit bridge through the use of this same audio encoding standard.

The retransmit bridge object supports retransmission across multiple waveforms and SDR wireline interfaces. The bridge may work with half and full duplex modes. In half duplex and non-combined full duplex modes one source at a time may capture the bridge, rules may be selected to determine which source captures the bridge (first come first served, last come first served, or source precedence). For example, the retransmit bridge may support retransmission across multiple waveforms to support applications such as quick dissemination of nuclear, biological, and chemical (NBC) attacks across the battlefield. Each waveform is responsible for providing its own unique squelch processing. For example, VHF FM uses squelch tones, while HF uses syllabic and data squelches. In combined full duplex mode, multiple sources at a time may use the bridge.

SDRs provide significant connectivity improvement because SDRs may support a wide range of waveforms compared to Legacy radios. Without some sort of over-the-air signaling, however, Legacy radio users are still dependent upon using static predefined retransmit communication planning or operators who manually patch in desired waveforms.

Table 2 describes an exemplary method of how to determine whether two waveforms can be interconnected.

As an example of how to use these tables, a specific waveform mode has been selected and an example of how to determine which other waveforms and modes can be interconnected to the selected waveform mode is provided. As an example, ESIP FH CT Voice is chosen as the specific waveform.

1. Looking at Table 1, it can be seen that ESIP FH CT Voice maps into the CVSD Communications Service.
2. Looking at FIG. 14, it can be seen that the chosen waveform can only interconnect with other waveforms at the same security level as the ESIP FH CT Voice waveform.
3. Looking at Table 5, it can be seen that ESIP FH CT Voice mode maps into the CVSD Voice Communication Service.
4. Looking at Table 3, we see that the CVSD Voice Communication Service can be interconnected to:
   a. Analog Voice via Voice Method 1
   b. LPC-10e Voice via Voice Method 1
   c. MELP Voice via Voice Method 1
   d. CELP Voice via Voice Method 1
   e. CVSD Voice via Voice Method 2
   f. AMBE Voice via Voice Method 1
   g. VoIP via Voice Method 3

Looking at Table 3, it can be seen that Analog Voice, LPC-10e Voice, MELP Voice, CELP Voice, CVSD Voice, and AMBE Voice can only be interconnected with the communication services and methods already listed above.

5. Looking at Table 1, it can be seen which waveforms support the communication services listed in 4.a. through 4.i. above:
   h. Analog Voice is supported by the following waveforms:
      HF SSB (ALE), HF ISB (ALE), ESIP
   i. LPC-10e Voice is supported by the following waveforms:
      HF SSB (ALE), HF ISB (ALE)
   j. MELP Voice is supported by the following waveforms:
      HF SSB (ALE), HF ISB (ALE)
   k. CVSD Voice is supported by the following waveforms:
      ESIP
6. Looking at Table 5 and applying the appropriate method from Table 3, it can be seen which waveform modes could be used to support the communication services listed in 5.a. through 5.i. above. In the discussion below, it may be assumed that all CT modes are at the same security level. Otherwise, they would not be allowed.

l. Analog Voice and Method 1:
HF SSB (ALE)
(1) Non-ECCM/PT/Voice—Not allowed due to differences in security levels
(2) ECCM/PT/Voice—Not allowed due to differences in security levels
Similarly, other waveforms (HF ISB (ALE), ESIP,) with PT Analog Voice modes will not be allowed due to difference in security levels m. LPC-10e Voice and Method 1:
HF SSB (ALE)
(1) Non-ECCM/PT/LPC-10e Voice—Not allowed due to differences in security levels
(2) Non-ECCM/CT/LPC-10e Voice—Interconnect audio bits above COMSEC and vocoder
(3) ECCM/PT/LPC-10e Voice—Not allowed due to differences in security levels
(4) ECCM/CT/LPC-10e Voice—Interconnect audio bits above COMSEC and vocoder
Similarly other waveforms (HF ISB (ALE)) with CT LPC-10e Voice modes will be allowed and interconnected as audio bits above COMSEC and vocoder, while other waveforms (HF ISB (ALE)) with PT LPC-10e Voice modes will not be allowed due to differences in security levels.

n. MELP Voice and Method 1:
HF SSB (ALE)
(1) Non-ECCM/PT/LPC-10e Voice—Not allowed due to differences in security levels
(2) Non-ECCM/CT/LPC-10e—Interconnect audio bits above COMSEC and vocoder
(3) ECCM/PT/LPC-10e Voice—Not allowed due to differences in security levels
(4) ECCM/CT/LPC-10e—Interconnect audio bits above COMSEC and vocoder
Similarly other waveforms (HF ISB (ALE) with CT LPC-10e Voice modes will be allowed and interconnected as audio bits above COMSEC and vocoder, while other waveforms (HF ISB (ALE)) with PT LPC-10e Voice modes will not be allowed due to differences in security levels.

o. CVSD Voice and Method 2:
ESIP
(1) SC/PT/Voice—Not allowed due to differences in security levels
(2) SC/CT/Voice (different keys)—Interconnect CVSD vocoded bits above COMSEC but below vocoder
(3) SC/CT/Voice (same keys)—Interconnect encrypted bits below COMSEC
(4) FH/PT/Voice—Not allowed due to differences in security level
(5) FH/CT/Voice (different keys)—Interconnect CVSD vocoded bits above COMSEC but below vocoder
(6) FH/CT/Voice (same keys)—Interconnect encrypted bits below COMSEC 7. In summary, the ESIP FH CT Voice can be interconnected with the following waveform modes:
p. HF SSB (ALE)-Non-ECCM/CT/LPC-10e Voice
q. HF SSB (ALE)-Non-ECCM/CT/MELP Voice
r. HF SSB (ALE)-ECCM/CT LPC-10e Voice
s. HF SSB (ALE)-ECCM/CT/MELP Voice
t. HF ISB (ALE)-Non-ECCM/CT/LPC-10e Voice
u. HF ISB (ALE)-Non-ECCM/CT/MELP Voice
v. HF ISB (ALE)-ECCM/CT/LPC-10e Voice
w. HF ISB (ALE)-ECCM/CT/MELP Voice
x. ESIP-SC/CT/Voice (same key and different keys)
y. ESIP-FH/CT/Voice (same key and different keys)

While the detailed drawings, specific examples and particular formulations given describe preferred and exemplary embodiments, they serve the purpose of illustration only. The inventions disclosed are not limited to the specific forms shown. For example, the methods may be performed in any of a variety of sequence of steps. The hardware and software configurations shown and described may differ depending on the chosen performance characteristics and physical characteristics of the computing devices. For example, the type of computing device, communications bus, or processor used may differ. The systems and methods depicted and described are not limited to the precise details and conditions disclosed. Furthermore, other substitutions, modifications, changes, and omissions may be made in the design, operating conditions, and arrangement of the exemplary embodiments without departing from the scope of the invention as expressed in the appended claims.

What is claimed is:

1. A software defined radio (SDR), used as a retransmission service, the software defined radio comprising:
a processor;
memory coupled to the processor,
a transceiver,
a program stored in memory and running on the processor, the program instantiating an application programming interface (API) that inherits from a base class, the API defining a retransmission bridge, creating waveform protocol stack objects and identifying crossbanding waveforms being requested.

2. The software defined radio of claim 1, wherein the APT comprises a software object.

3. The software defined radio of claim 1, wherein a single API scales to handle a plurality of crossbanding services, because of the inheritance from the base class.

4. The software defined radio of claim 1, wherein the retransmission bridge API is configured for half duplex voice waveforms and where the waveform chosen to be the bridge source can be chosen by a rule, the rule being one of first come first served, last come first served, and predefined waveform precedence levels.

5. The software defined radio of claim 1, wherein the retransmission bridge API is configured for non-combined full duplex voice waveforms and where the waveform chosen to be the bridge source can be chosen by a rule, the rule being one of first come first served, last come first served, and predefined waveform precedence levels.

6. The software defined radio of claim 1, wherein the retransmission bridge API is configured for combined full duplex voice waveforms.

7. The software defined radio of claim 1, wherein the retransmission bridge API is configured for voice conferencing.

8. The software defined radio of claim 1, wherein the retransmission bridge API is configured for similar serial data protocols.

9. The software defined radio of claim 1, wherein the retransmission bridge API is configured for a serial data protocol conversion service.

10. A method of implementing a software defined radio as a radio retransmission service, the software defined radio including a processor memory coupled to the processor a transceiver, and a program stored in memory and running on the processor, the method comprising:

creating a retransmission bridge software object with a base class application programming interface (API) using the program in the software defined radio;

creating waveform protocol stack objects with APIs inherited from the retransmission bridge base class API;

identifying crossbanding waveforms being requested;

determining a location in the waveform protocol stack objects with identical APIs inherited from the retransmission bridge base class API;

instantiating the retransmission bridge at identical waveform protocol stack APIs inherited from the retransmission bridge base class API.

11. The method of claim 10, further comprising:

setting up a communications session utilizing the retransmission bridge.

12. The method of claim 10, further comprising:

providing additional waveforms in a software defined radio.

13. The method of claim 10, wherein the retransmission bridge API is configured for bridging half duplex voice waveforms, where the waveform chosen to be the bridge source can be chosen by a rule, the rule being one of first come first served, last come first served, and predefined waveform precedence levels.

14. The method of claim 10, wherein the retransmission bridge API is configured for bridging non-combined full duplex voice waveforms, where the waveform chosen to be the bridge source can be chosen by a rule, the rule being one of first come first served, last come first served, and predefined waveform precedence levels.

15. The method of claim 10, wherein the retransmission bridge API is configured for bridging combined fall duplex voice waveforms.

16. The method of claim 10, wherein the retransmission bridge API is configured for voice conferencing.

17. The method of claim 10, wherein the retransmission bridge API is configured for similar serial data protocols.

18. The method of claim 10, wherein the retransmission bridge API is configured for a serial data protocol conversion service.

19. A software defined radio used as a retransmission service, comprising:

means for creating a retransmission bridge software object with a base class application programming interface (API);

means for creating waveforms with APIs inherited film the retransmission bridge base class API;

means for identifying crossbanding waveforms being requested;

means for determining a location in a data stack in which to instantiate the retransmission bridge;

means for instantiating the retransmission bridge.

20. The radio of claim 19, further comprising:

means for setting up a communications session utilizing the retransmission bridge.

21. The radio of claim 19, further comprising:

means for providing additional waveforms in the software defined radio.

22. The apparatus of claim 19, wherein the retransmission bridge API is configured for half duplex waveforms and where the waveform chosen to be the bridge source can be chosen by a rule, the rule being one of first come first served, last come first served, and predefined waveform precedence levels.

23. The apparatus of claim 19, wherein the retransmission bridge API is configured for non-combined full duplex waveforms and where the waveform chosen to be the bridge source can be chosen by a rule, the rule being one of first come first served, last come first served, and predefined waveform precedence levels.

24. The apparatus of claim 19, wherein the retransmission bridge API is configured for combined full duplex waveforms.

25. The apparatus of claim 19, wherein the retransmission bridge API is configured for voice conferencing.

26. The apparatus of claim 19, wherein the retransmission bridge API is configured for similar serial data protocols.

27. The apparatus of claim 19, wherein the retransmission bridge API is configured for a serial data protocol conversion service.

* * * * *